US008600764B2

(12) United States Patent
Bahn

(10) Patent No.: US 8,600,764 B2
(45) Date of Patent: Dec. 3, 2013

(54) DETERMINING AN INITIAL COMMON SCALE FACTOR FOR AUDIO ENCODING BASED UPON SPECTRAL DIFFERENCES BETWEEN FRAMES

(75) Inventor: Jae Mi Bahn, Seoul (KR)

(73) Assignee: Core Logic Inc., Seoul (KR)

( * ) Notice: Subject to any disclaimer, the term of this patent is extended or adjusted under 35 U.S.C. 154(b) by 869 days.

(21) Appl. No.: 12/717,095

(22) Filed: Mar. 3, 2010

(65) Prior Publication Data

US 2010/0228556 A1 Sep. 9, 2010

(30) Foreign Application Priority Data

Mar. 4, 2009 (KR) ..... 10-2009-0018623

(51) Int. Cl.
*G10L 19/00* (2013.01)
*G10L 19/14* (2006.01)

(52) U.S. Cl.
USPC ..... 704/500; 704/224; 704/230

(58) Field of Classification Search
USPC ..... 704/205, 224, 230, 500–501
See application file for complete search history.

(56) References Cited

U.S. PATENT DOCUMENTS

| | | | | |
|---|---|---|---|---|
| 5,758,315 | A | 5/1998 | Mori | |
| 6,625,574 | B1 * | 9/2003 | Taniguchi et al. | 704/229 |
| 7,613,605 | B2 * | 11/2009 | Funakoshi | 704/219 |
| 8,346,547 | B1 * | 1/2013 | Tang | 704/230 |
| 2004/0230425 | A1 | 11/2004 | Yu et al. | |
| 2005/0075871 | A1 * | 4/2005 | Youn | 704/229 |
| 2006/0053006 | A1 * | 3/2006 | Kim et al. | 704/229 |
| 2007/0033022 | A1 | 2/2007 | Ouyang et al. | |
| 2007/0033024 | A1 | 2/2007 | Budnikov et al. | |
| 2009/0037166 | A1 * | 2/2009 | Wang | 704/200.1 |
| 2009/0083042 | A1 * | 3/2009 | Suwabe | 704/500 |
| 2010/0106509 | A1 * | 4/2010 | Shimada | 704/500 |

FOREIGN PATENT DOCUMENTS

| | | | |
|---|---|---|---|
| EP | 0737959 | A1 | 10/1996 |
| JP | 09288498 | A | 11/1997 |
| JP | 2001306095 | A | 11/2001 |
| JP | 2008065162 | A | 3/2008 |

(Continued)

OTHER PUBLICATIONS

Kurniawati et al. "New implementation techniques of an efficient MPEG advanced audio coder." Consumer Electronics, IEEE Transactions on 50.2, 2004, pp. 655-665.*

(Continued)

*Primary Examiner* — James Wozniak
(74) *Attorney, Agent, or Firm* — Lowe Hauptman & Ham, LLP

(57) ABSTRACT

Disclosed herein is a quantization method and apparatus of an audio encoder. The quantization method comprises calculating an absolute value of a maximum frequency spectrum of a first frame, externally received, by analyzing frequency spectrum data of the first frame, setting an initial value of a common scale factor to be used to quantize the first frame based on the absolute value of the maximum frequency spectrum of the first frame and an absolute value of a maximum frequency spectrum of a second frame, which has previously been calculated, and quantizing the frequency spectrum data of the first frame based on the set initial value of the common scale factor. Accordingly, before quantization is performed, an initial value of a common scale factor which is almost close to a value of an actual common scale factor can be previously set.

13 Claims, 8 Drawing Sheets

(56) References Cited

FOREIGN PATENT DOCUMENTS

| | | | |
|---|---|---|---|
| JP | 2008083295 | A | 4/2008 |
| KR | 10-2009-0009784 | A | 1/2009 |
| WO | 2005004113 | A1 | 1/2005 |

OTHER PUBLICATIONS

Wang et al. "A new bit-allocation algorithm for AAC encoder based on linear prediction." Communication Technology, 2008. ICCT 2008. 11th IEEE International Conference on. IEEE, Nov. 2008, pp. 726-729.*

* cited by examiner

DETERMINING AN INITIAL COMMON SCALE FACTOR FOR AUDIO ENCODING BASED UPON SPECTRAL DIFFERENCES BETWEEN FRAMES

CLAIM OF PRIORITY

This application claims the benefit of Korean Patent Application No. 10-2009-0018623, filed on Mar. 4, 2009 in the Korean Intellectual Property Office, the contents of which are incorporated herein in their entirety by reference.

BACKGROUND

The present disclosure relates to audio encoding technologies.

Moving Picture Experts Group (MPEG) audio encoding is an international standard developed by International Organization for Standardization/International Electrotechnical Commission (ISO/IEC) for high-quality and high-efficiency encoding. The MPEG audio encoding method has been standardized in parallel with moving picture encoding within MPEG installed in ISO/IEC SC29/WG11. Such MPEG audio encoding is an encoding standard which emphasizes minimizing the loss of the quality of subjective sound while realizing a high compression rate.

The MPEG audio encoding algorithm is configured to prevent a listener from perceiving quantization noise occurring during an encoding process through various methods. For example, the MPEG audio encoding algorithm can use a psychoacoustic model to maintain a high quality of sound even after encoding by taking into account the human perception characteristic and removing perceptive redundancy. An audio encoder using the psychoacoustic model can reduce the number of codes and realize a high compression rate by omitting pieces of detailed information which are difficult for a human being to perceive at the time of encoding using the acoustic characteristic of a human being who listens to an audio signal.

The audio encoder using the psychoacoustic model uses a threshold in quite, which is a minimum sound level that can be heard by a human being and a masking effect in which sound having a level less than a threshold value is shielded by specific sound. For example, in the audio encoder using the psychoacoustic model, frequency components having a very high or low level, which are rarely heard by a human being, can be excluded from the encoding process, and frequency components shielded by specific frequency components may be encoded with accuracy lower than original accuracy.

The audio encoder using the psychoacoustic model performs quantization and encoding for data using values which are calculated based on the psychoacoustic model. For example, an MPEG audio encoder converts audio data of the time domain into audio data of the frequency domain, finds the amount of maximum allowed noise (that is, maximum allowed distortion) in each frequency band using a psychoacoustic model module, and then performs quantization and encoding based on the amount of maximum allowed noise.

SUMMARY

Techniques, systems and apparatus are described to provide quantization of audio data, to significantly reducing the number of repeated loops at the time of quantization by presetting the initial value of a common scale factor used to quantize the audio data so that the initial value approaches the value of an actual common scale factor to the maximum extent possible.

To achieve the above object, according to an aspect of the present disclosure, there is provided a quantization method of an audio encoder. The quantization method includes calculating an absolute value of a maximum frequency spectrum of a first frame, externally received, by analyzing frequency spectrum data of the first frame; setting an initial value of a common scale factor to be used to quantize the first frame based on the absolute value of the maximum frequency spectrum of the first frame and an absolute value of a maximum frequency spectrum of a second frame, which has previously been calculated; and quantizing the frequency spectrum data of the first frame based on the set initial value of the common scale factor.

Calculating the absolute value of the maximum frequency spectrum of the first frame may comprise calculating an absolute value of a portion having a greatest absolute value, from among the frequency spectrum data of the first frame.

Setting the initial value of the common scale factor to be used to quantize the first frame may comprise comparing the absolute value of the maximum frequency spectrum of the first frame and the absolute value of the maximum frequency spectrum of the second frame using a specific comparison algorithm; and calculating the initial value of the common scale factor used to quantize the first frame using a calculation algorithm corresponding to a result of the comparison.

Comparing the absolute value of the maximum frequency spectrum of the first frame and the absolute value of the maximum frequency spectrum of the second frame may comprise calculating a first binary log value by applying a binary log to the absolute value of the maximum frequency spectrum of the first frame; calculating a second binary log value by applying a binary log to the absolute value of the maximum frequency spectrum of the second frame; and calculating a difference value between the first binary log value and the second binary log value.

Setting the initial value of the common scale factor to be used to quantize the first frame may comprises extracting the calculation algorithm corresponding to the difference value between the first binary log value and the second binary log value; and calculating the initial value of the common scale factor using the extracted calculation algorithm. Extracting the calculation algorithm corresponding to the difference value between the first binary log value and the second binary log value may comprise comparing at least one constant value and the difference value between the first binary log value and the second binary log value.

Calculating the initial value of the common scale factor used to quantize the first frame may comprise performing an operation using at least any one of a value of a common scale factor of the second frame, a value in which the second binary log value has been subtracted from the first binary log value, and a specific constant value.

The quantization method may further comprise, if the calculated absolute value of the maximum frequency spectrum of the first frame is 0, setting a previously set constant value as an initial value of a common scale factor of the first frame.

The quantization method may further comprise adjusting the common scale factor such that the number of bits used by encoded data of the quantized data does not exceed the number of available bits which has been previously set. adjusting the common scale factor may comprises calculating the number of bits used by the encoded data of the quantized data; comparing the calculated number of bits used and the number of available bits; and if, as a result of the comparison, the calculated number of bits used exceeds the number of available bits, adjusting the common scale factor.

The quantization method may further comprise adjusting the common scale factor such that a value in which the number of bits used has been subtracted from the number of available bits does not exceed a threshold value.

The quantization method may further comprise a band scale factor corresponding to each of frequency bands of the frequency spectrum data of the first frame such that a distortion of each of the frequency bands does not exceed an allowed distortion of the corresponding frequency band.

According to another aspect of the present disclosure, there is provided a method of setting an initial value of a common scale factor used to quantize frequency spectrum data of a first frame externally received. The method comprises determining whether a block type of the first frame differs from a block type of a second frame which is a frame anterior to the first frame; and if, as a result of the determination, the block type of the first frame is determined to differ from the block type of the second frame, setting a specific constant value as the initial value of the common scale factor, and if, as a result of the determination, the block type of the first frame is determined to be identical to the block type of the second frame, calculating the initial value of the common scale factor based on absolute values of maximum frequency spectra of the first frame and the second frame.

According to yet another aspect of the present disclosure, there is provided a quantization apparatus of an audio encoder. The quantization apparatus comprises an initial value setting module configured to calculate an absolute value of a maximum frequency spectrum for each frame by analyzing externally received frequency spectrum data of a frame unit and to set an initial value of a common scale factor of the corresponding frame according to a degree of a change between the frames of the calculated absolute values of the maximum frequency spectra; and at least one function module configured to quantize the frequency spectrum data based on the initial value of the common scale factor, set by the initial value setting module, and to adjust a common scale factor such that the number of bits used by encoded data of the quantized data does not exceed the number of available bits which has previously been set.

The initial value setting module may be configured to calculate an absolute value of a maximum frequency spectrum of a current frame and an absolute value of a maximum frequency spectrum of a previous frame and to compare the absolute value of the maximum frequency spectrum of the current frame and the absolute value of the maximum frequency spectrum of the previous frame using a specific comparison algorithm.

The initial value setting module may be configured to calculate a first binary log value by applying a binary log to the absolute value of the maximum frequency spectrum of the current frame, calculate a second binary log value by applying a binary log to the absolute value of the maximum frequency spectrum of the previous frame, and extract a calculation algorithm for calculating an initial value of a common scale factor of the current frame according to a difference value between the first binary log value and the second binary log value.

The at least one function module may comprises a quantization module configured to quantize frequency spectrum data of the current frame based on an initial value of a common scale factor of the current frame; and an inner loop module configured to adjust the common scale factor such that the number of bits used by encoded data of the data quantized by the quantization module does not exceed the number of available bits which has previously been set. The inner loop module may be configured to adjust the common scale factor such that a difference value between the number of available bits and the number of bits used does not exceed a threshold value.

The described techniques, apparatus and systems can provide one or more of the following advantages. Using the techniques, apparatus and systems described herein, an initial value of a common scale factor for quantizing the frequency spectrum data of a frame can be preset so that the initial value approaches the value of an actual common scale factor to the maximum extent possible. Accordingly, when quantization is performed, the number of repeated loops for adjusting a common scale factor can be reduced, and so a computational load of the audio encoder can be significantly reduced.

BRIEF DESCRIPTION OF DRAWINGS

Like reference numerals in the drawings denote like elements.

DETAILED DESCRIPTION

Only some embodiments of the present disclosure are described below with reference to the accompanying drawings so that those skilled in the art can easily implement the present disclosure. In the described embodiments, technical terminologies are presented for illustrative purposes only. The present disclosure is not limited to the presented terminologies and each terminology includes all technical synonyms having similar definitions and operational descriptions intended to accomplish similar objectives.

Figure 1:
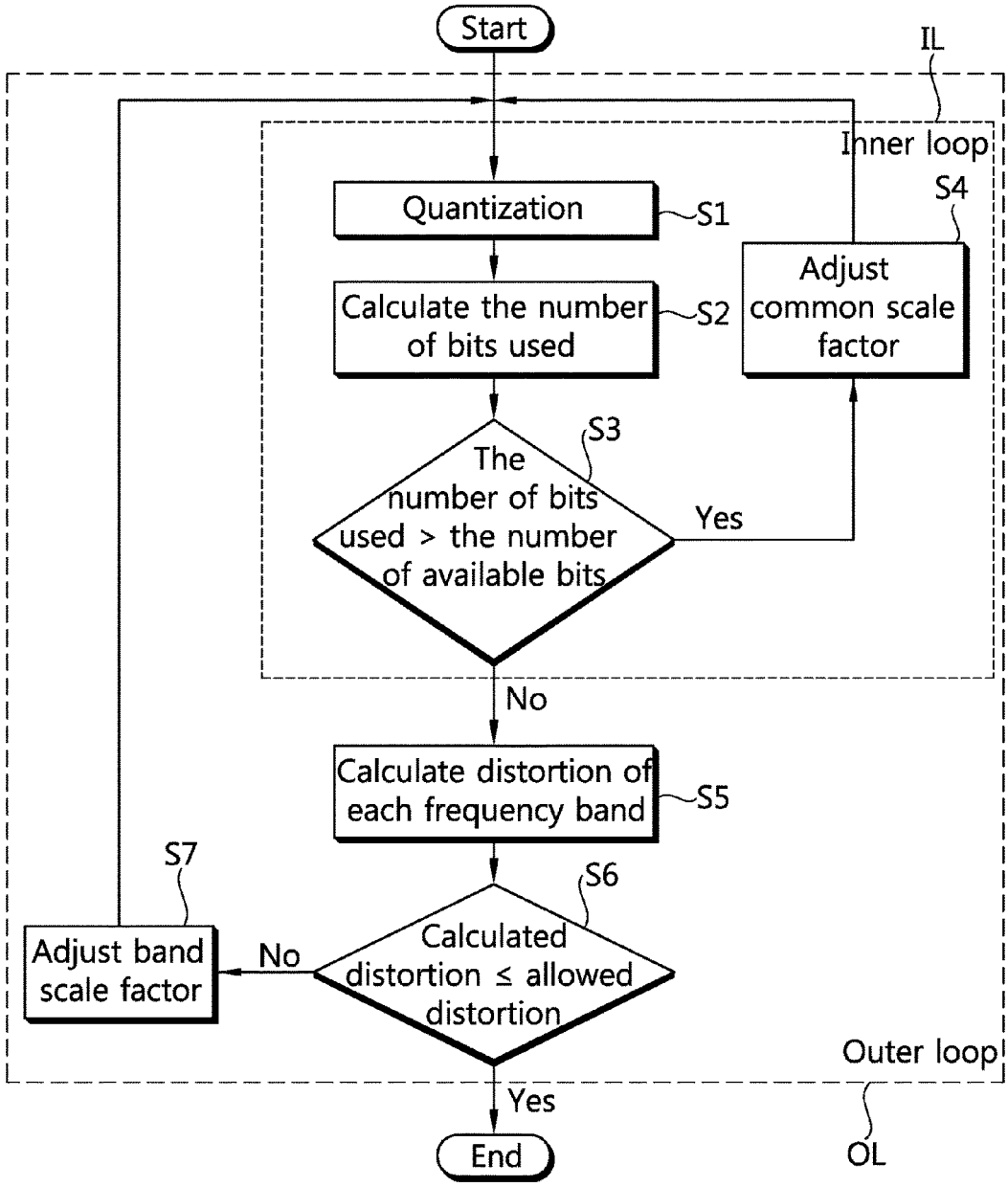
FIG. 1 is a flowchart illustrating a typical quantization process of an audio encoder using a psychoacoustic model.

FIG. 1 is a flowchart illustrating a typical quantization process of a conventional audio encoder that uses a psychoacoustic model. A conventional audio encoder can perform a multi-step loop in order to quantize the data of the frequency domain. The multi-step loop can include an inner loop IL and an outer loop OL.

In the inner loop IL, the data of the frequency domain received on a frame basis are quantized using a common scale factor and band scale factors at step S1. The common scale factor is adjusted such that the number of bits when the quantized data are encoded (that is, the number of bits used) does not exceed the number of available bits at steps S2 to S4.

In the outer loop OL, the band scale factor is adjusted such that the distortion of each frequency band does not exceed an allowed distortion of the corresponding frequency band at steps S5 to S7.

When the quantization process is performed as described above, the inner loop includes the process of comparing the number of bits used when quantized data are encoded and the number of available bits. Here, the encoding process is performed in each loop because the number of bits used can be calculated after the quantized data are encoded. This is because the quantized data are changed for every loop according to a change in the common scale factor and so a codeword and the length of a codeword are changed.

As described above, the quantization process of the known audio encoder includes repeatedly performing the outer loop and the inner loop until an optimal value is obtained. In particular, the inner loop is accompanied by many operations because the inner loop includes a process of quantizing data and a calculation process based on encoded data of the quantized data. When the number of repeated loops is increased in the inner loop, the number of times of quantization and encoding is increased, thereby excessively increasing a computational load in the audio encoder. Further, the increase in the computational load of the audio encoder delays the time that it takes to perform the encoding process and becomes an excessive load on hardware resources.

Figure 2:
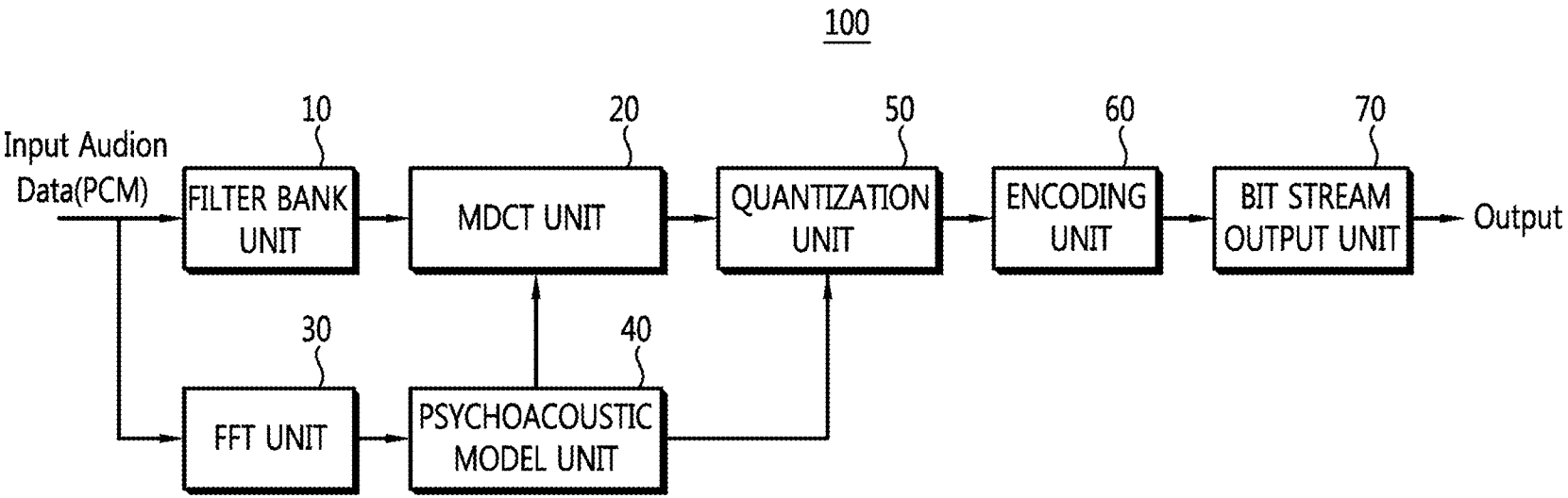
FIG. 2 is a block diagram of an audio encoder including a quantization apparatus for realizing a quantization method according to a specific embodiment of the present disclosure.

FIG. 2 is a block diagram of an audio encoder including a quantization apparatus for realizing a quantization method according to an embodiment of the present disclosure. As shown in FIG. 2, the audio encoder 100 receives external audio data (for example, Pulse Code Modulation (PCM) data) in the time domain on a frame basis, processes the received audio data, and outputs encoded bit streams in a specific format. The audio encoder 100 includes a filter bank unit 10, a Modified Discrete Cosine Transform (MDCT) unit 20, a Fast Fourier Transform (FFT) unit 30, a psychoacoustic model unit 40, a quantization unit 50, an encoding unit 60, and a bit stream output unit 70.

The filter bank unit 10 receives external audio data in the time domain on a frame basis, converts the audio data into audio data in the frequency domain (that is, frequency spectrum data), and subdivides the converted frequency spectrum data of the frame unit into a number of frequency bands. For example, the filter bank unit 10 can subdivide the frequency spectrum data of the frame unit into, for example, 32 sub-bands in order to remove the statistical redundancy of the audio data.

The FFT unit 30 converts the external audio data in the time domain into frequency spectrum data and transmits the converted frequency spectrum data to the psychoacoustic model unit 40.

The psychoacoustic model unit 40 receives the frequency spectrum data from the FFT unit 30 and calculates an allowed distortion for each frequency band of the frequency spectrum data in order to remove perceptive redundancy resulting from the acoustic characteristic of a human listener. Here, the allowed distortion can refer to a maximum allowed distortion of the distortions which cannot be perceived by a human listener. The psychoacoustic model unit 40 can provide the quantization unit 50 with the calculated allowed distortion for each frequency band.

The psychoacoustic model unit 40 can determine whether a window has been switched by calculating perceptual energy and can transmit window switching information to the MDCT unit 20. A window can switch between different block types as described below. A block type of a frame can be classified into at least four types. For example, a frame of a portion in which an audio signal sharply changes can be called a short block. A frame of a portion in which an audio signal does not sharply change can be called a long block. A frame of a portion in which an audio signal changes from a long block to a short block can be called a long stop block, and a frame of a portion in which an audio signal changes from a short block to a long block can be called a long start block.

The psychoacoustic model unit 40 can output the window switching information to indicate that a short window, a long window, a long stop window, or a long start window is applied based on whether the block type of a frame being processed is a short block, a long block, a long stop block, or a long start block, respectively.

The MDCT unit 20 subdivides the frequency spectrum data, which is divided into a number of frequency bands by the filter bank unit 10, based on the window switching information received from the psychoacoustic model unit 40 in order to increase the frequency resolution of the frequency spectrum data. For example, when the window switching information indicates a long window, the MDCT unit 20 can subdivide the frequency spectrum data into finer sub-bands than the sub-bands (e.g., 32 sub-bands) generated by the filter bank unit 10 using multiple point MDCT (e.g., 36 point MDCT). When the window switching information indicates a short window, the MDCT unit 20 can subdivide the frequency spectrum data into finer sub-bands than the sub-bands (e.g., 32 sub-bands) generated by the filter bank unit 10 using multiple point MDCT (e.g., 12 point MDCT).

The quantization unit 50 can perform a quantization process on the frequency spectrum data of the frame unit received from the MDCT unit 20. Furthermore, the quantization unit 50 can quantize the frequency spectrum data, adjust a common scale factor such that a number of bits used by encoded data of the quantized data does not exceed the number of available allowed bits, and adjust a band scale factor such that the distortion of each of the frequency bands of the frequency spectrum data does not exceed an allowed distortion.

Before performing the quantization process on the frequency spectrum data, the quantization unit 50 can preset an initial value of the common scale factor, which is almost the same as a value of the common scale factor which will be actually used for the quantization process, in order to reduce the number of repeated loops for adjusting a common scale factor and a band scale factor. Here, the quantization unit 50 can preset an initial value of the common scale factor by estimating an initial value of the common scale factor based on the amount of a change in the absolute value of a maximum frequency spectrum between the frames.

The encoding unit 60 can perform a function of encoding the data quantized by the quantization unit 50. The bit stream output unit 70 can format the data encoded by the encoding unit 60 in a specific format (for example, a bit stream format designated according to MPEG2, etc.) and output bit streams.

Figure 3:
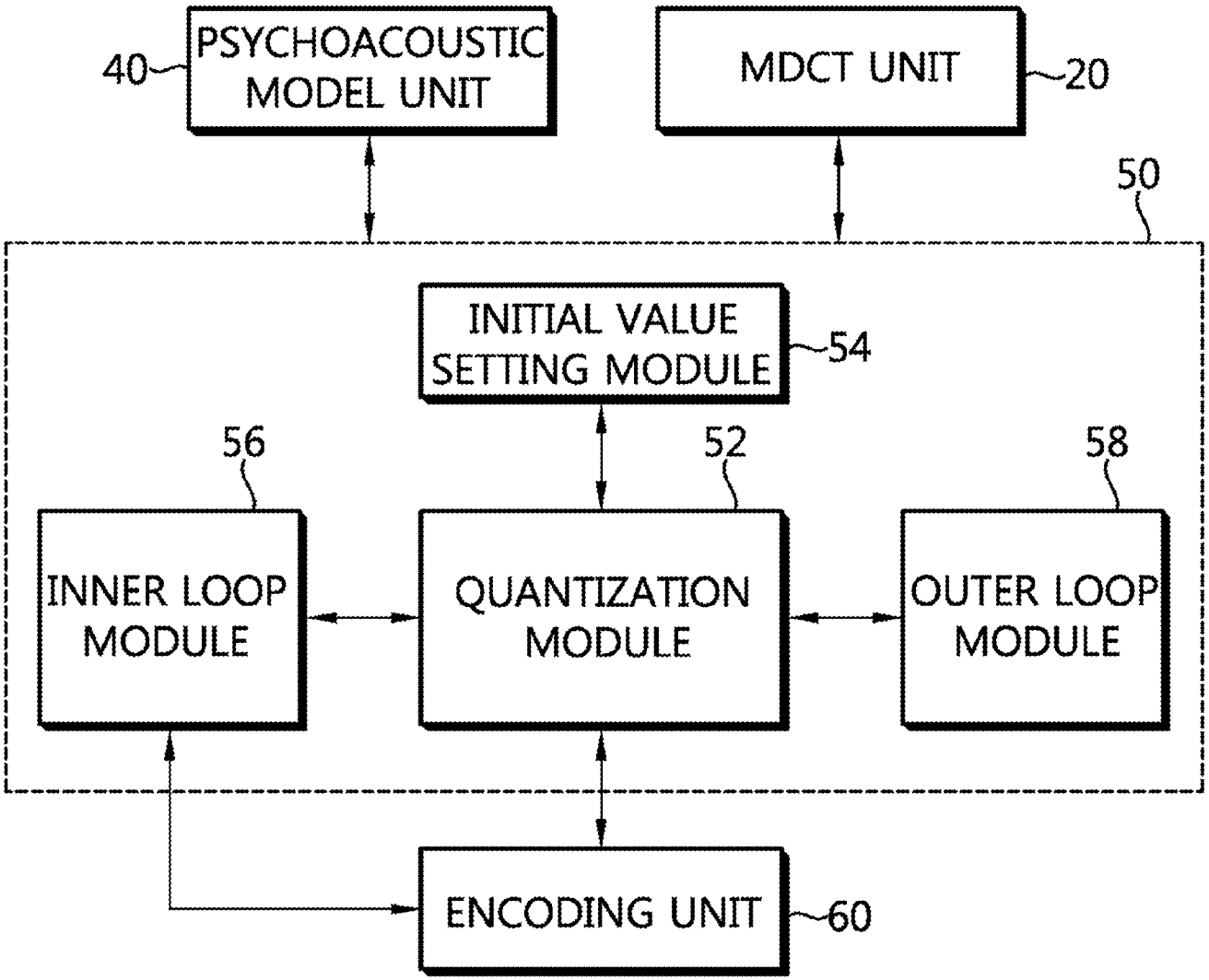
FIG. 3 is a detailed block diagram of a quantization unit shown in FIG. 2.

FIG. 3 is a detailed block diagram of the quantization unit 50 shown in FIG. 2. Referring to FIGS. 2 and 3, the quantization unit 50 can include an initial value setting module 54, a quantization module 52, an inner loop module 56, and an outer loop module 58.

The initial value setting module 54 performs a function of estimating an initial value of the common scale factor based on the amount of a change in the absolute value of a maximum frequency spectrum between the frames and setting the estimated initial value. The absolute value of a maximum frequency spectrum can refer to the greatest value among the absolute values of frequency spectrum data of a frame. For example, the absolute value of the maximum frequency spectrum can refer to the absolute value of a frequency band having the greatest absolute value, from among a number of frequency bands included in the frequency spectrum data of a frame.

The initial value setting module 54 can find an absolute value of the maximum frequency spectrum of a corresponding frame by analyzing the frequency spectrum data of the frame unit, received from the MDCT unit 20, and compare the absolute value of the maximum frequency spectrum of the corresponding frame and an absolute value of the maximum frequency spectrum of a frame processed prior to the corresponding frame using a specific algorithm.

For example, the initial value setting module 54 can find an absolute value of the maximum frequency spectrum of a current frame by analyzing the frequency spectrum data of a current frame received from the MDCT unit 20 and comparing the absolute value of the maximum frequency spectrum of the current frame and an absolute value of the maximum frequency spectrum of a previous frame (that is, a frame processed prior to the current frame) using a specific comparative algorithm. Here, the absolute value of the maximum frequency spectrum of the previous frame is determined before a quantization process is performed on the previous frame.

The initial value setting module 54 calculates the initial value of the common scale factor which can be used to quantize the frequency spectrum data of the current frame using a specific calculation algorithm based on the result obtained using the comparative algorithm. In other words, the initial value setting module 54 calculates the initial value of the common scale factor using a corresponding calculation algorithm based on a change in the frequency spectrum absolute value of the current frame as compared with the frequency spectrum absolute value of the previous frame.

The initial value setting module 54 can pre-store the calculation algorithm, corresponding to the result obtained using the comparative algorithm, in the form of a table. A process of setting the initial value of the common scale factor is described further below. The initial value setting module 54 may set an initial value of a flag may be needed for the operation of the inner loop module 56.

The quantization module 52 can perform the quantization process on the frequency spectrum data of the frame unit received from the MDCT unit 20. When the quantization process is performed, the quantization module 52 can use a common scale factor adjusted by the inner loop module 56 and a band scale factor adjusted by the outer loop module 58.

The inner loop module 56 operates an inner loop to adjust the common scale factor in association with the quantization module 52 and the encoding unit 60. For example, the inner loop module 56 can control the quantization module 52 such that the quantization module 52 performs the quantization process. Additionally, the inner loop module 56 can perform a process of adjusting the common scale factor such that the number of bits used by encoded data of the quantized data does not exceed the number of available bits which has previous been set. In the inner loop that is first performed by the inner loop module 56, an initial value of the common scale factor set by the initial value setting module 54 when the quantization process is performed can be used as the common scale factor.

When the number of bits used does not exceed the number of available bits, the inner loop module 56 may adjust the common scale factor such that a difference between the number of available bits and the number of bits used does not exceed a threshold value. For example, the inner loop module 56 can compare a value in which the number of bits used has been subtracted from the number of available bits and a previously set critical value and, when, as a result of the comparison, the resulting value exceeds the critical value, adjust the common scale factor.

The outer loop module 58 performs a function of adjusting a band scale factor such that a distortion of each of the frequency bands of the frequency spectrum data does not exceed an allowed distortion of the corresponding frequency band. For example, the outer loop module 58 can calculate a distortion of each of the frequency bands of the frequency spectrum data, compare the calculated distortion of each frequency band and an allowed distortion received from the psychoacoustic model unit 40, and when, as a result of the comparison, the calculated distortion exceeds the allowed distortion, adjust a corresponding band scale factor.

Examples for an apparatus to realize the quantization method according to the embodiments of the present disclosure has been described above. A procedure of performing quantization using the above-described quantization unit 50 (that is, the quantization apparatus) is described below. Further, the functions of the quantization unit 50 will become more evident through the following description.

Figure 4:
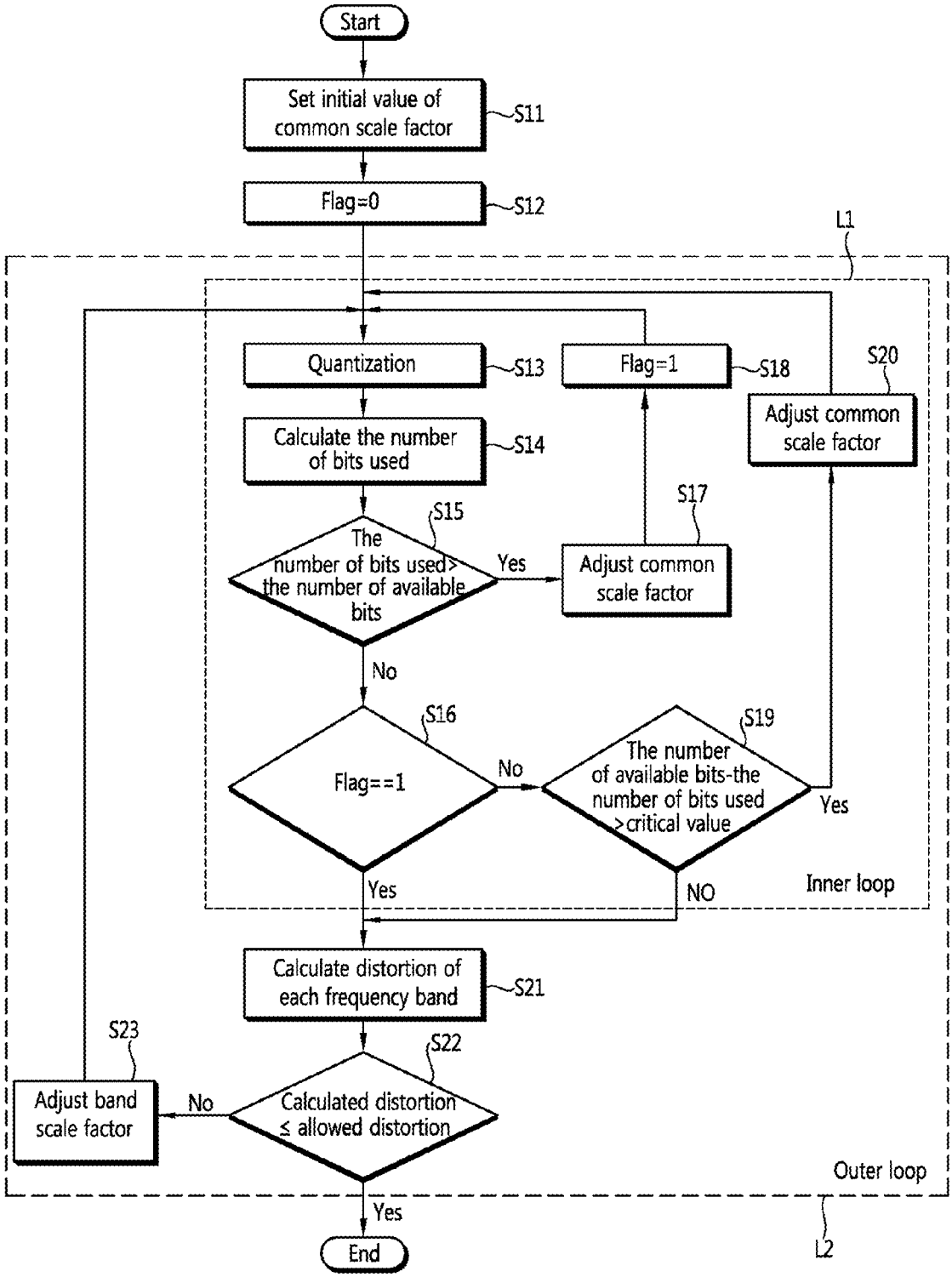
FIG. 4 is a flowchart illustrating the quantization method according to a specific embodiment of the present disclosure.

FIG. 4 is a flowchart illustrating an exemplary quantization method according to an embodiment of the present disclosure. The quantization unit 50 first estimates and sets an initial value of a common scale factor which can be used to quantize the frequency spectrum data of a frame received from the outside (for example, the MDCT unit) at step S11. To estimate the initial value of the common scale factor, the quantization unit 50 uses the amount of a change in an absolute value of the maximum frequency spectrum between frames. The absolute value of the maximum frequency spectrum, as described above, can refer to an absolute value of a portion having the greatest value, from among values obtained by performing an absolute value operation on the frequency spectrum data of a frame.

To estimate the initial value of the common scale factor, the quantization unit 50 calculates an absolute value of the maximum frequency spectrum of an externally received current frame by analyzing the frequency spectrum data of the current frame. The quantization unit 50 compares the calculated absolute value of the maximum frequency spectrum of the current frame and an absolute value of the maximum frequency spectrum of a previous frame (that is, a frame processed prior to the current frame) using a comparative algorithm. Here, the absolute value of the maximum frequency spectrum of the previous frame could have already been determined before the previous frame is processed.

For example, the quantization unit 50 can calculate a first binary log value by applying a binary log('$\log_2$') to the calculated absolute value of the maximum frequency spectrum of the current frame and comparing the first binary log value and a binary log value of an absolute value of the maximum frequency spectrum of the previous frame (that is, a second binary log value). The second binary log value could have already been calculated when the initial value of the common scale factor of the previous frame is calculated.

Next, the quantization unit 50 can extract a predetermined calculation algorithm from previously stored information based on the comparison result obtained using the comparative algorithm and calculate the initial value of the common scale factor which can be used to quantize the current frame using the extracted calculation algorithm. For example, the quantization unit 50 can calculate the initial value of the common scale factor which can be used to quantize the current frame using a specific calculation algorithm corresponding to a difference value between the two binary log values (that is, the first binary log value and the second binary log value).

The calculation algorithm for setting the initial value of the common scale factor can be expressed by the following equation 1.

$$\text{est_common_scalefac}[i] = \begin{cases} 10, & \text{if max_spec}[i] == 0 \\ CSF[i-1] + diff[i] \times A, & \text{if } C < |diff[i]| < D \\ CSF[i-1] + diff[i] \times B, & \text{if } D \le |diff[i]| \\ CSF[i-1], & \text{if } C \ge |diff[i]| \end{cases} \quad \text{[Equation 1]}$$

The elements used in Equation 1 are defined as follows:

I=Frame index. 'I' can represent a current frame and 'i−1' can present a previous frame.

est_common_scalefac[i]=Initial value of a common scale factor estimated to perform quantization on a current frame.

CSF[i−1]=A common scale factor determined by quantization and encoding processes for a previous frame.

max_spec[i]=An absolute value of a maximum frequency spectrum of a current frame.

A, B, C, D=Constant values which can be properly determined experimentally.

diff[i]=A value in which the binary log value of an absolute value of the maximum frequency spectrum of a current frame (e.g., max_spec[i−1]) has been subtracted from the binary log value of an absolute value of the maximum frequency spectrum of a previous frame (e.g., max_spec[i]). Such a diff[i] can be expressed by the following equation 2.

$$\text{diff}[i]=\log_2(\text{max_spec}[i])-\log_2(\text{max_spec}[i-1]) \quad \text{[Equation 2]}$$

Referring to Equation 1, to estimate the initial value of the common scale factor of the current frame, the quantization unit 50 uses a calculation algorithm corresponding to the absolute value of a value in which a binary log value (for example, a second binary log value) of the absolute value of the maximum frequency spectrum of the previous frame has been subtracted from a binary log value (for example, a first binary log value) of the absolute value of the maximum frequency spectrum of the current frame (e.g., a difference |diff[i]| between the two binary log values).

For example, when the difference |diff[i]| between the two binary log values is greater than C (e.g., a constant value), but less than D (e.g., another constant value), the initial value of the common scale factor of the current frame can be calculated by adding the common scale factor CSF[i+1] of the previous frame and a value in which the difference diff[i] between the first binary log value and the second binary log value is multiplied by A (e.g., yet another constant value).

For example, when the difference |diff[i]| between the two binary log values is equal to or greater than D (e.g., yet another constant value), the initial value of the common scale factor of the current frame can be calculated by adding the common scale factor CSF[i+1] of the previous frame and a value in which the difference diff[i] between the first binary log value and the second binary log value is multiplied by B (e.g., yet another constant value).

For example, when the difference |diff[i]| between the two binary log values is equal to or less than C (e.g., yet another constant value), the initial value of the common scale factor of the current frame can be set to have the same value as the common scale factor CSF[i+1] of the previous frame.

When the absolute value of the maximum frequency spectrum of the current frame is 0, the initial value of the common scale factor of the current frame can be set to a previously set value (for example, 10).

The above-described constant values A, B, C, and D can be properly set based on experimental values according to the system. For example, in some embodiments, A can be set to 3.58, B can be set to 1.8, C can be set to 0.4, and D can be set to 15.

The quantization unit 50 can store pieces of information corresponding to equations 1 and 2 (for example, the comparative algorithm, the calculation algorithm corresponding to the difference |diff[i]| between the two binary log values, and a calculation algorithm, for example, a set value when an absolute value of the maximum frequency spectrum of a frame is 0) and can extract necessary information from the stored information when calculating the common scale factor.

Figure 5:
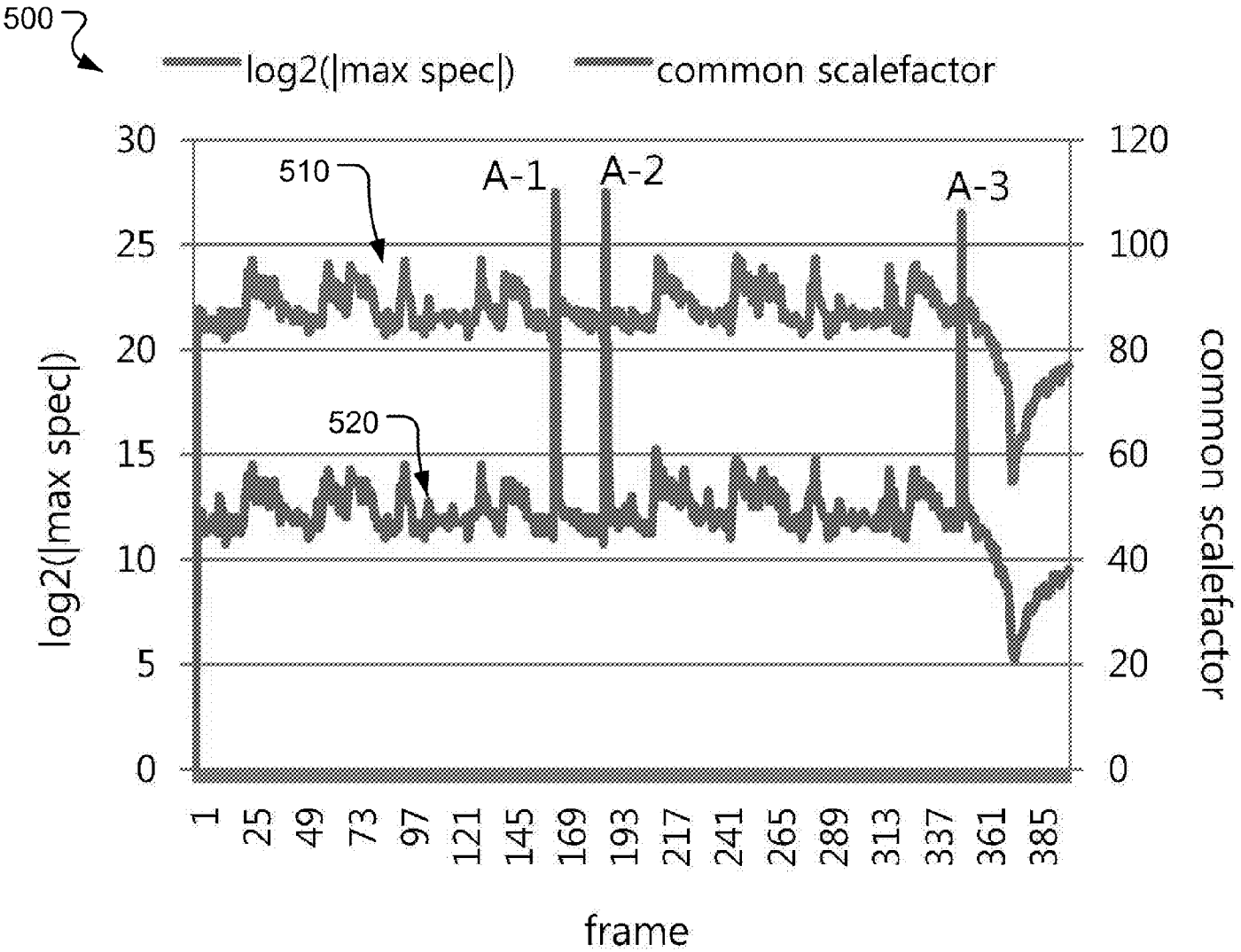
FIG. 5 is a graph showing the comparison of binary log values of absolute values of maximum frequency spectra of respective frames and determination values of actual common scale factors used to quantize the respective frame.

FIG. 5 is a graph 500 showing an exemplary comparison of binary log values ($\log_2$|max spec|) 510 of absolute values of maximum frequency spectra of respective frames and determination values of actual common scale factors 520 used to quantize the respective frame. FIG. 5 shows that, in 400 frames sequentially inputted to the audio encoder, the binary log values 510 of maximum frequency spectra of absolute values of the respective frames have a similar tendency to the determination values of actual common scale factors 520 of the respective frames.

The frames corresponding to points A-1, A-2, and A-3 shown in FIG. 5 can refer to portions at which audio data sharply change (e.g., portions of the audio data at which the block types of the frames are changed). For example, the points can be frames corresponding to portions of the audio data that undergo a change from the long block to the short block or portions of the audio data undergo a change from the short block to the long block.

When frames corresponding to respective portions of the audio data where the block types of the frames are sharply changed as described above, the binary log values of absolute values of maximum frequency spectra of the respective frames can differ from the determination values of actual common scale factors used to quantize the respective frame. Accordingly, the quantization unit 50 can set the initial value of a common scale factor to a previously set value (for example, 10) with respect to a frame corresponding to a portion of the audio data where the block type of a frame is sharply changed.

For example, the quantization unit 50 can determine whether the block type of a current frame and the block type of a previous frame differ from each other. If, as a result of the determination, the block type of the current frame and the block type of the previous frame are determined to differ from each other, the quantization unit 50 can set a previously set value as an initial value of the common scale factor of the current frame. However, if, as a result of the determination, the block type of the current frame and the block type of the previous frame are determined to be identical with each other, the quantization unit 50 can set an initial value of the common scale factor of the current frame based on the absolute values of maximum frequency spectra of the current frame and the previous frame as described above.

Figure 6:
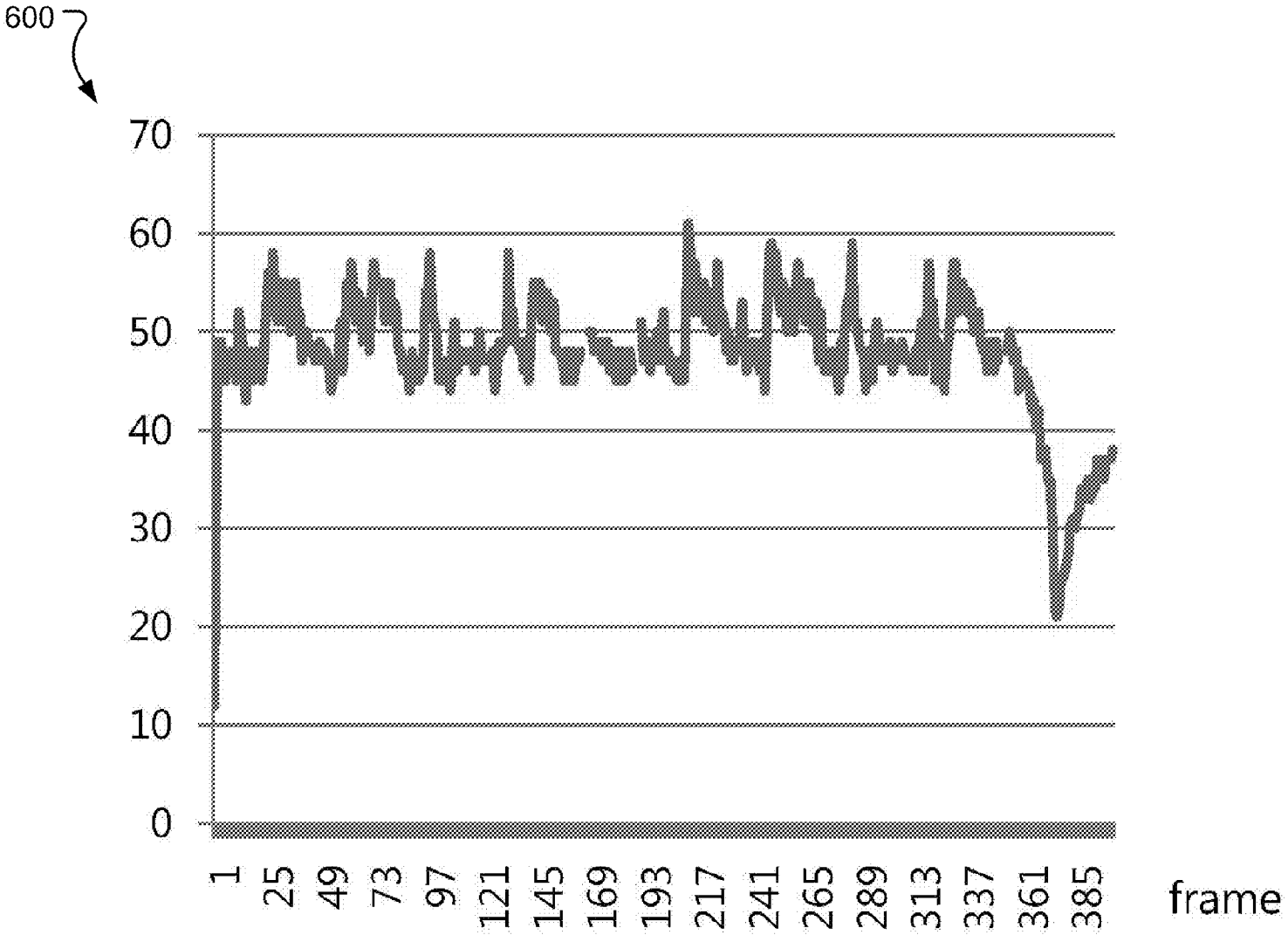
FIG. 6 is a graph showing determination values of actual common scale factors used to quantize frequency spectrum data of respective frames.
Figure 7:
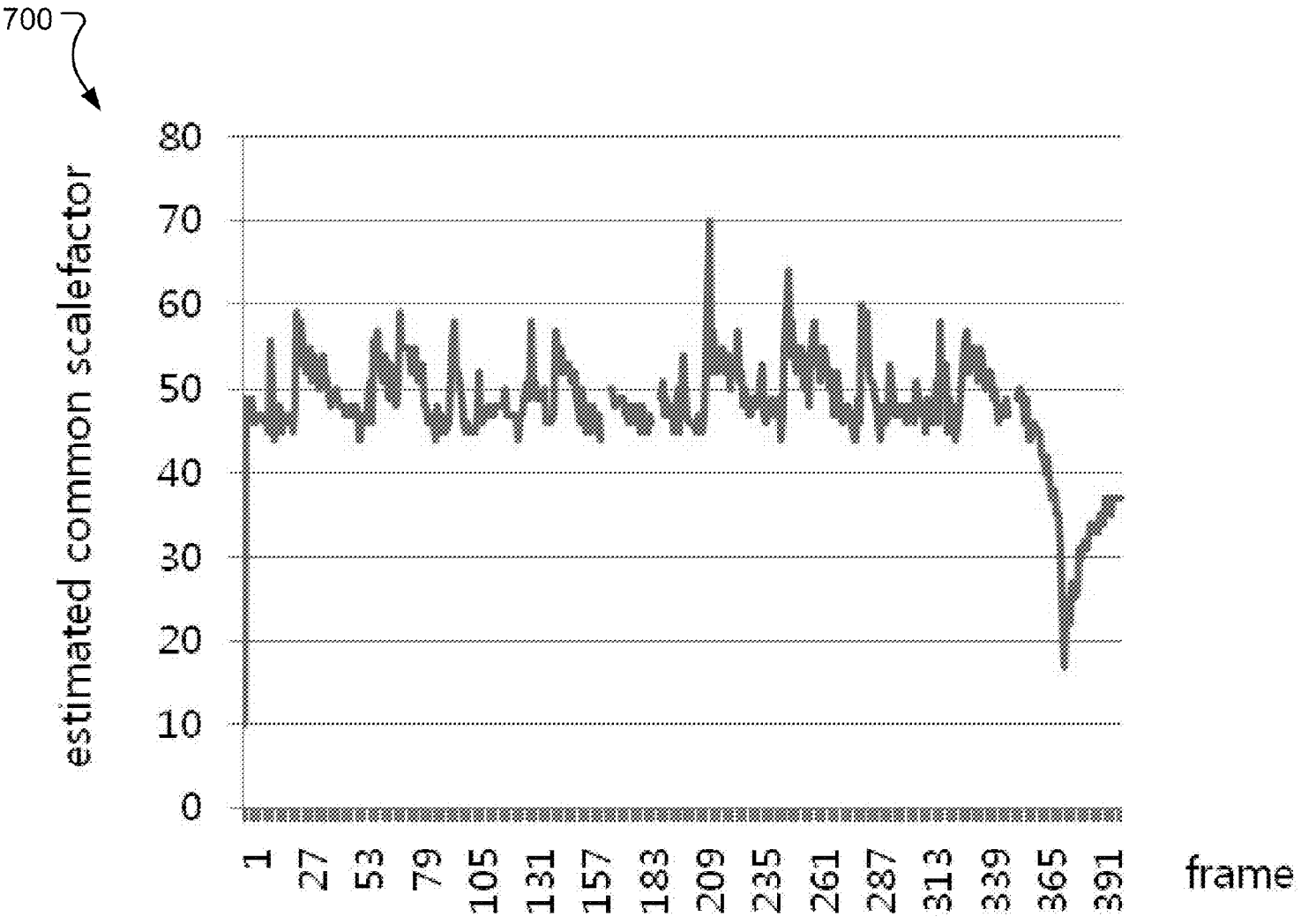
FIG. 7 is a graph showing initial values of common scale factors of respective frames, which have been estimated according to a method of estimating initial values of common scale factors.
Figure 8:
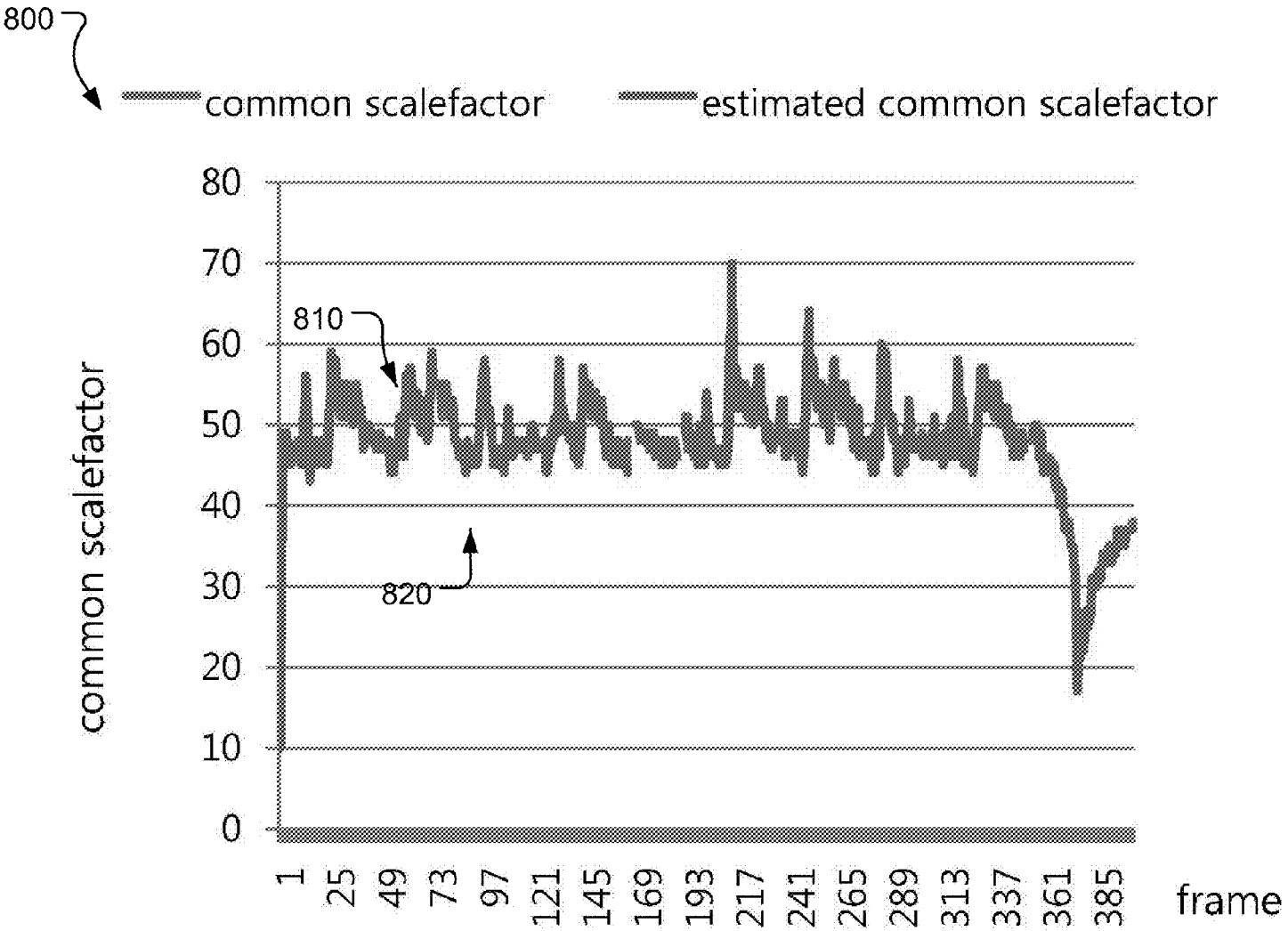
FIG. 8 is a graph showing the comparison of the values of the common scale factors shown in FIG. 6 and the initial values of the common scale factors shown in FIG. 7.

FIG. 6 is a graph 600 showing determination values of actual common scale factors used to quantize frequency spectrum data of respective frames. FIG. 7 is a graph 700 showing initial values of common scale factors of respective frames, which have been estimated according to a method of estimating initial values of common scale factors. FIG. 8 is a graph 800 showing the comparison of the values of the common scale factors 810 shown in FIG. 6 and the initial values of the common scale factors 820 shown in FIG. 7.

FIGS. 6 to 8 show that the determination values of the actual common scale factors used to quantize frequency spectrum data are almost identical to the initial values of the common scale factors estimated according to the above-described method (see e.g., common scalefactors 810 appear to be almost identical to the initial common scalefactors 820 in FIG. 8).

As described above, before the frequency spectrum data of a specific frame are quantized, the initial value of a common scale factor to be used for the quantization is estimated and set in such a way as to be almost similar to the determination value of an actual common scale factor. Accordingly, the number of repeated loops for adjusting the common scale factor can be significantly reduced, and so a computational load caused by the quantization and encoding processes in the operation of the encoder can be greatly reduced.

After setting the initial value of the common scale factor as described above, the quantization unit 50 can set a flag necessary to perform the inner loop L to a first value (for example, 0) at step S12 and then perform the inner loop L1 for adjusting the common scale factor at steps S13 to S20. When performing the inner loop L1, the quantization unit 50 uses the set initial value of the common scale factor as a start value of the common scale factor.

In the inner loop L1, the quantization unit 50 quantizes the frequency spectrum data at step S13. For example, in the first loop of the inner loop L1, the quantization unit 50 can perform the quantization based on the set initial value of the common scale factor.

Next, the quantization unit 50 adjusts common scale factor such that the number of bits used by encoded data of the quantized data does not exceed the number of available bits that has previously been set at steps S14, S15, S17, and S18.

The steps S14, S15, S17, and S18 are described further below. The quantization unit 50 can calculate the number of bits used, of encoded data of the quantized data, at step S14. For example, when the encoding unit 60 encodes the quantized data, the quantization unit 50 can calculate the number of bits in the encoded data.

Next, the quantization unit 50 compares the number of bits used that has been calculated and the number of available bits that has previously been set in order to determine whether the number of bits used exceeds the number of available bits at step S15. When, as a result of the determination, the number of bits used is determined to exceed the number of available bits, the quantization unit 50 can adjust the common scale factor at step S17. For example, the quantization unit 50 can increase the value of the common scale factor by a specific value (for example, 1). After adjusting the common scale factor, the quantization unit 50 can set the flag to a second value (for example, 1) at step S18 and then return to the step S13 in which the inner loop L1 is repeated.

When, as a result of the determination at step S15, the number of bits used is determined to be equal to or less than the number of available bits, the quantization unit 50 adjusts the common scale factor such that a difference between the number of available bits and the number of bits used does not exceed a threshold value at steps S16, S19, and S20.

The steps S16, S19, and S20 are described further below. The quantization unit 50 determines whether the flag is equal to the second value (for example, 1) at step S16. When, as a result of the determination, the flag is determined not to equal the second value, the quantization unit 50 determines whether a value in which the number of bits used has been subtracted from the number of available bits is more than the critical value at step S19.

When, as a result of the determination at step S19, the value in which the number of bits used has been subtracted from the number of available bits is determined to be more than the critical value, the quantization unit 50 can adjust the common scale factor at step S20. For example, the quantization unit 50 can decrease a value of the common scale factor by a predetermined value (for example, 1). After adjusting the common scale factor, the quantization unit 50 returns to the step S13 in which the inner loop L1 is repeated.

However, when, as a result of the determination at step S16, the flag is determined not to be equal to the second value or when, as a result of the determination at step S19, the value in which the number of bits used has been subtracted from the number of available bits is determined to be equal to or less than the critical value, the quantization unit 50 can perform an outer loop L2.

In the outer loop L2, the quantization unit 50 can first calculate a distortion of each of the frequency bands of the frequency spectrum data at step S21. Next, the quantization unit 50 determines whether the calculated distortion of each frequency band is equal to or less than an allowed distortion of the corresponding frequency band at step S22.

When, as a result of the determination at step S22, the calculated distortion of each frequency band is determined to be greater than the allowed distortion of the corresponding frequency band, the quantization unit 50 adjusts the corresponding band scale factor at step S23 and then returns to the step S13. However, when, as a result of the determination at step S22, the calculated distortion of each frequency band is determined to be equal to or less than the allowed distortion of the corresponding frequency band, the quantization unit 50 can terminate the quantization process.

While this specification contains many specifics, these should not be construed as limitations on the scope of any invention or of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments.

Only a few implementations and examples are described and other implementations, enhancements and variations can be made based on what is described and illustrated in this application.

What is claimed is:

1. A quantization method performed by an audio encoder, the quantization method comprising:

calculating an absolute value of a maximum frequency spectrum of a first frame of audio data received from an external source by analyzing frequency spectrum data of the first frame;

setting an initial value of a common scale factor to be used to quantize the first frame of audio data based on the calculated absolute value of the maximum frequency spectrum of the first frame and an absolute value of a maximum frequency spectrum of a second frame of audio data, which has been calculated prior to calculating the absolute value of a maximum frequency spectrum of the first frame; and quantizing the frequency spectrum data of the first frame of audio data based on the set initial value of the common scale factor, wherein setting the initial value of the common scale factor to be used to quantize the first frame of audio data comprises:

comparing the absolute value of the maximum frequency spectrum of the first frame of audio data and the absolute value of the maximum frequency spectrum of the second frame of audio data, using a corresponding comparison algorithm; and calculating the initial value of the common scale factor used to quantize the first frame of audio data using a calculation algorithm corresponding to a result of the comparison, wherein comparing the absolute value of the maximum frequency spectrum of the first frame of audio data and the absolute value of the maximum frequency spectrum of the second frame of audio data comprises:

calculating a first binary log value by applying a binary log to the absolute value of the maximum frequency spectrum of the first frame of audio data;

calculating a second binary log value by applying a binary log to the absolute value of the maximum frequency spectrum of the second frame of audio data; and calculating, a difference value between the first binary log value and the second binary log value.

2. The quantization method of claim 1, wherein calculating the absolute value of the maximum frequency spectrum of the first frame of audio data comprises calculating an absolute value of a portion of the frequency spectrum, data of the first frame of audio data having a greatest absolute value.

3. The quantization method of claim 1, wherein setting the initial value of the common scale factor to be used to quantize the first frame of audio data comprises:

determining the calculation algorithm corresponding to the difference value between the first binary log value and the second binary log value; and calculating the initial value of the common scale factor using the determined calculation algorithm.

4. The quantization method of claim 3, wherein determining the calculation algorithm corresponding to the difference value between the first binary log value and the second binary log value comprises comparing at least one constant value and the difference value between the first binary log value and the second binary log value.

5. The quantization method of claim 1, wherein calculating the initial value of the common scale factor used to quantize the first frame of audio data comprises performing an operation using at least one of a value of a common scale factor of the second frame of audio data, a value in which the second binary log value has been subtracted from the first binary log value, or a constant value.

6. The quantization method of claim 1, further comprising, when the calculated absolute value of the maximum frequency spectrum of the first frame of audio data is 0, assigning a preset constant value as an initial value of a common scale factor of the first frame of audio data.

7. The quantization method of claim 1, further comprising adjusting the common scale factor such that a number of bits used to encode the quantized data does not exceed a number of available bits.

8. The quantization method of claim 7, wherein adjusting the common scale factor comprises:

calculating the number of bits used to encode the quantized data;

comparing the calculated number of bits used to encode the quantized data and the number of available bits; and when, as a result of the comparison, the calculated number of bits used to encode the quantized data exceeds the number of available bits, adjusting the common scale factor.

9. The quantization method of claim 7, further comprising adjusting the common scale factor such that a value representing a difference between the number of bits used in encoding the quantized data and the number of available bits does not exceed a threshold value.

10. The quantization method of claim 1, further comprising a band scale factor corresponding to each frequency band in the frequency spectrum data of the first frame of audio data such that a distortion associated with each frequency band does not exceed an allowed distortion for the corresponding frequency band.

11. A quantization apparatus for performing quantization of audio data using an audio encoder, the quantization apparatus comprising:

an initial value setting module configured to calculate an absolute value of a maximum frequency spectrum for each frame of the audio data by analyzing frequency spectrum data of a given frame of the audio data and to set an initial value of a common scale factor of the corresponding frame of the audio data according to an amount of a change in the calculated absolute values of the maximum frequency spectra between the frames of the audio data; and at least one function module configured to quantize the frequency spectrum data based on the initial value of the common scale factor, set by the initial value setting module, and to adjust a common scale factor such that a number of bits used to encode the quantized data does not exceed a number of available bits, wherein the initial value setting module is configured to calculate an absolute value of a maximum frequency spectrum of a given frame of the audio data and an absolute value of a maximum frequency spectrum of a frame of the audio data previous to the given frame and to compare the absolute value of the maximum frequency spectrum of the given frame of the audio data and the absolute value of the maximum frequency spectrum of the frame of the audio data previous to the given frame of the audio data using a specific comparison algorithm, wherein the initial value setting module is configured to calculate a first binary log value by applying a first binary log calculation to the absolute value of the maximum frequency spectrum of the given frame of the audio data, calculate a second binary log value by applying a second binary log calculation to the absolute value of the maximum frequency spectrum of the frame of the audio data previous to the given frame of the audio data, and determine a calculation algorithm for calculating an initial value of a common scale factor of the current frame based on a difference value between the first binary log value and the second binary log value.

12. The quantization apparatus of claim 11, wherein the at least one function module comprises:

a quantization module configured to quantize frequency spectrum data of the given frame of the audio data based on an initial value of a common scale factor of the current frame of the audio data; and an inner loop module configured to adjust the common scale factor such that a number of bits used to encode the data quantized by the quantization module does not exceed a number of available bits.

13. The quantization apparatus of claim 12, wherein the inner loop module is configured to adjust the common scale factor such that a difference value between the number of available bits and the number of bits used to encode the quantized data does not exceed a threshold value.

* * * * *